US009964298B2

(12) United States Patent
Lynch

(10) Patent No.: US 9,964,298 B2
(45) Date of Patent: May 8, 2018

(54) HEAT DISTRIBUTING LAMP SHIELD

(71) Applicant: SABIC Global Technologies B.V., Bergen op Zoom (NL)

(72) Inventor: Christopher Terence Lynch, Amsterdam (NL)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 2 days.

(21) Appl. No.: 15/026,993

(22) PCT Filed: Oct. 7, 2014

(86) PCT No.: PCT/IB2014/065096
§ 371 (c)(1),
(2) Date: Apr. 4, 2016

(87) PCT Pub. No.: WO2015/052637
PCT Pub. Date: Apr. 16, 2015

(65) Prior Publication Data

US 2016/0252242 A1 Sep. 1, 2016

Related U.S. Application Data

(60) Provisional application No. 61/887,710, filed on Oct. 7, 2013.

(51) Int. Cl.
*F21V 29/83* (2015.01)

(52) U.S. Cl.
CPC ..... *F21V 29/83* (2015.01); *F21S 41/37* (2018.01); *F21S 41/435* (2018.01)

(58) Field of Classification Search
CPC ..... F21S 48/147; F21V 29/83
USPC ..... 362/547
See application file for complete search history.

(56) References Cited

U.S. PATENT DOCUMENTS 5,567,033 A * 10/1996 Tanaka ..... F21S 48/1233 362/303
5,782,550 A * 7/1998 Ohashi ..... F21S 48/142 362/255
6,170,970 B1 1/2001 Eto
6,238,072 B1 5/2001 Eto
6,435,704 B1 8/2002 Montet et al.
6,709,139 B2 * 3/2004 Ishida ..... F21S 48/145 362/509

(Continued)

FOREIGN PATENT DOCUMENTS

DE 202004001269 U1 4/2004
FR 2500116 A1 8/1982
JP H09223405 A 8/1997

OTHER PUBLICATIONS

International Preliminary Report on Patentability; International Application No. PCT/IB2014/065096; International Filing Date: Oct. 4, 2014; dated: Jan. 20, 2016; 17 Pages.

(Continued)

*Primary Examiner* — Toan Ly
(74) *Attorney, Agent, or Firm* — Cantor Colburn LLP

(57) ABSTRACT

In an example a lamp shield comprises: a front face; a skirt extending from the front face, wherein the skirt comprises a heat spreader; and an extended arm connected to the front face or the skirt. A headlamp assembly can comprise: a reflector and the lamp shield.

14 Claims, 5 Drawing Sheets

(56) References Cited

U.S. PATENT DOCUMENTS

| | | | | |
|---|---|---|---|---|
| 2003/0179589 | A1* | 9/2003 | Eto | F21S 48/1118 362/547 |
| 2004/0145908 | A1* | 7/2004 | Ognian | F21S 48/142 362/516 |
| 2004/0264197 | A1* | 12/2004 | Bewig | F21V 7/22 362/294 |
| 2008/0037267 | A1 | 2/2008 | Converse et al. | |
| 2012/0033419 | A1* | 2/2012 | Kim | F21S 8/026 362/235 |
| 2012/0268936 | A1* | 10/2012 | Pickard | F21K 9/90 362/249.02 |
| 2013/0208469 | A1* | 8/2013 | Progl | F21V 29/506 362/235 |

OTHER PUBLICATIONS

International Search Report; International Application No. PCT/IB2014/065096; International Filing Date: Oct. 4, 2014; dated: Apr. 30, 2015; 5 Pages.

Written Opinion of the International Searching Authority; International Application No. PCT/IB2014/065096; International Filing Date: Oct. 4, 2014; dated: Apr. 30, 2015; 7 Pages.

* cited by examiner

HEAT DISTRIBUTING LAMP SHIELD

CROSS REFERENCE TO RELATED APPLICATIONS

This application is a National Stage Application of PCT/IB2014/065096, filed Oct. 7, 2014, which claims the benefit of U.S. Provisional Application No. 61/887,710, filed Oct. 7, 2013, both of which are incorporated by reference in their entirety herein.

BACKGROUND

The present disclosure relates generally to lamp shields, such as lamp shields for vehicle headlamps.

In certain markets, such as the automotive market, headlamp reflectors, housings and other components are often manufactured using thermoplastic or thermoset material. However, reflectors, housings, and other components of a headlamp assembly made of thermoplastic or thermoset material are prone to damage due to thermal energy released from the headlamp. Conventional lamp shields direct thermal energy from the lamp backward toward the reflector and the base of the lamp causing local hot spots which can damage the reflector, housing, and/or other components of the headlamp assembly.

Accordingly, what is needed is a lamp shield capable of reducing the occurrence and intensity (e.g., temperature) of hot spots within the headlamp assembly.

BRIEF DESCRIPTION

Disclosed herein are headlamp assembly components, such as lamp shields, and headlamp assemblies comprising the same.

In an example a lamp shield comprises: a front face; a skirt extending from the front face, wherein the skirt comprises a heat spreader; and an extended arm connected to the front face or the skirt.

The above described and other features are exemplified by the following figures and detailed description.

BRIEF DESCRIPTION OF THE DRAWINGS

Refer now to the figures, which are exemplary embodiments, and wherein the like elements are numbered alike.

Figure 1:
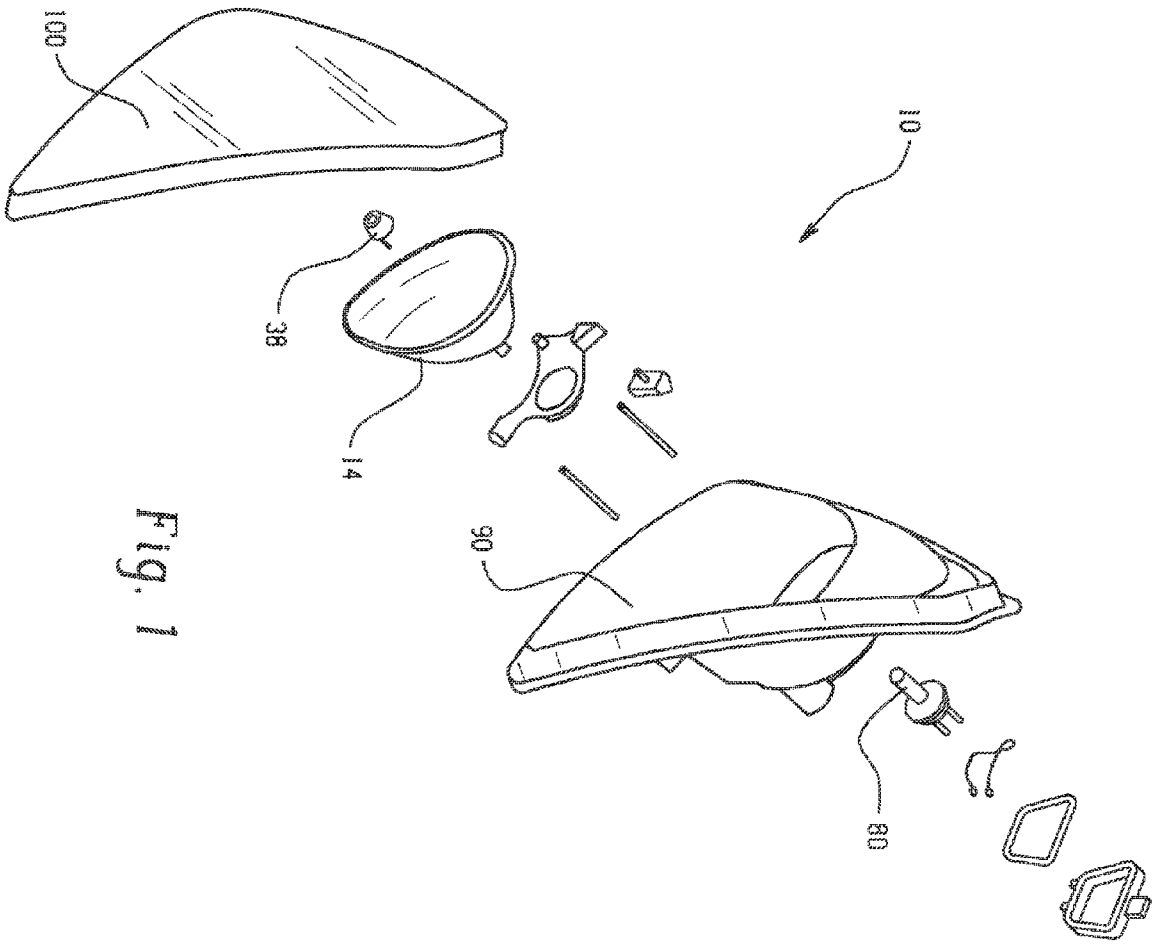
FIG. 1 depicts an exploded view of a headlamp assembly.

The figures are exemplary only and are not drawn to a particular scale.

DETAILED DESCRIPTION

A vehicle headlamp assembly can include a lamp, lamp shield, reflector, and housing. The lamp can be any type of light source such as incandescent, electroluminescent, gas discharge, high-intensity discharge, or other light source. These lamps can radiate a range of light wavelengths including visible and non-visible light (e.g., infrared light or thermal energy). A reflector can surround the periphery of the lamp to focus the visible light rays emitted by the lamp into a beam of light. Because of the reflector's proximity to the lamp it is susceptible to hot spots (e.g., areas of locally high temperature) that can result from thermal energy released from the lamp.

Thermal energy can be released from the lamp. This can be due to inefficiency in converting electrical energy into visible light. When activated the lamp can transfer thermal energy to gases such as surrounding gases, and can induce a gradient in the gas temperature within the headlamp assembly volume. In turn the gases naturally move, e.g., hotter gases can be buoyed vertically opposite the direction in which Earth's gravity acts, as the temperature gradient drives convection. When positioned proximal to the thermal energy source of the lamp (e.g., filament, arc, plasma, diode, and the like) a lamp shield can block the natural flow path of the hot gas and urge the hot gases rearward toward the base of the lamp and the area of the reflector proximal to the lamp base. Hot gas flow diverted rearward toward the reflector can transfer thermal energy onto the surface of the reflector which can accumulate locally and result in temperature hot spots. Similarly, thermal energy can accumulate on other components of the headlamp assembly, such as the housing, leading to thermal hot spots. When the reflector or other components are made of plastic or thin metal they can be susceptible to heat related failures due to these hot spots. Failures can include, but are not limited to, material deformation, delamination, bubbling, hazing, fracturing, and/or embrittling.

Improved lamp shields for use in lamp assemblies can distribute and disperse thermal energy transferred from a lamp. These lamp shields can distribute thermal energy released by the lamp across a larger surface area of the reflector and/or housing and can reduce the gas temperatures by mixing cooler gases and hotter gases together. These lamp shields can reduce the difference between the maximal and minimal temperatures throughout the headlamp assembly. The hot spot temperature can be lowered. Temperature distribution can be more uniform throughout the headlamp assembly. Lamp shields capable of lowering hot spot temperatures throughout the headlamp assembly can allow for the use of less expensive and/or thinner materials in the assembly components, which can reduce manufacturing cost.

Headlamp assemblies can include a lamp, a lamp shield, a reflector, and an assembly housing. The lamp shield can further include an extended arm and cup portion, wherein the cup portion further includes a front face with a perimeter edge and a skirt extending from the perimeter edge to form a cavity. The shape of the front face can be any simple closed polygon with straight or curved edges (triangular, square, rectangular, pentagon, hexagon, heptagon, octagon, nonagon, and the like), or can be circular, or oval. A skirt disposed continuously, or discontinuously, along the perimeter edge of the front face, can extend from the perimeter edge of the front face to a distal end of the skirt creating a cavity into which the lamp can extend. The front face and/or skirt can be closed, i.e. solid without an opening therethrough, or, each can further include a gas flow hole (opening therethrough) which allows for movement of gases in and out of the cavity through the front face and/or skirt. A gas flow hole allows for free convection to induce gas mixing between hotter and colder gases enclosed within the headlamp assembly, which can act to distribute the thermal energy released by the lamp to a larger volume of gas thereby reducing the maximal gas temperature and raising the minimal gas temperature (i.e. reduce the standard deviation of gas temperatures within the headlamp assembly). As a result, when the gases impinge on surfaces within the headlamp assembly they give off less energy which correlates to a reduced standard deviation of the surface temperature distribution throughout surfaces of the headlamp assembly. A gas flow hole through the front face and/or skirt can have any shape, and can be located anywhere on the front face and/or skirt.

It is also contemplated that the cup portion can be formed without a front face, where the front face is completely open, and even without a peripheral skirt, but with only a heat spreader. In this case the lamp shield includes only an extended arm and a skirt or an extended arm and a heat spreader. This can reduce the cost of the lamp shield when light is blocked from the lamp tip inherently by the lamp design, e.g., when the lamp tip is painted, has surface features or is otherwise opaque or configured in such a way as to block light from exiting the tip of the lamp.

The skirt can further include a heat spreader. The heat spreader can be located in the upper section of the lamp shield, vertically above the centroid of the front face of the lamp shield. In particular, the heat spreader can be located vertically above at least a portion of the cavity, and/or the lamp, such that hot gases moving from the cavity, and/or lamp, can impinge the inside surface (i.e. surface facing the cavity) of the heat spreader. The heat spreader can convert at least a portion of the vertical momentum of the hot gas moving away from the lamp (and/or exiting the cavity) and impinging inside surface of the heat spreader into horizontal momentum. In particular, the heat spreader can have a cross-sectional shape to convert at least a portion of the vertical component (z-axis direction in the attached Figures) and/or rearward component (x-axis direction in the attached Figures) of the gas velocity vector of the hot gases impinging the inside surface of the heat spreader into lateral (y-axis direction in the attached Figures) momentum away from the vertical centerline of the lamp and/or away from the lamp base. As a result, a gas stream impinging the inside (i.e. surface facing the cavity) of the heat spreader can be split into multiple streams and urged laterally away from the vertical centerline of the lamp without urging the entire gas flow rearward toward the base and distributing the hot gas flow over a larger surface area of the reflector and/or other headlamp assembly components. By locating the heat spreader above the point of origin of the hot gases it breaks the thermal load of the entire hot gas stream into multiple, smaller, streams and spreads them across a wider area of the headlamp assembly (in particular a larger area of the reflector and housing). The heat spreader also blocks a direct route to the reflector and housing as the gas naturally rises, which forces the gas onto a longer path and allows it to cool at least partially before reaching the reflector and housing. These features result in a more even distribution of the heat energy within the headlamp assembly.

The heat spreader can be formed by flow channels carved out of the skirt where the remaining skirt material between the flow channels is the heat spreader, or, can be formed as a local extension of the skirt away from the front face (extension in the z-axis direction from the distal end of the surrounding portions of the skirt). In either case the hot gases are separated and directed laterally away from the vertical centerline of the lamp by the heat spreader, which reduces the rearward flow toward the lamp base and/or vertical flow along the vertical centerline of the lamp. The heat spreader can be closed, i.e. solid, without holes therethrough, or can include gas flow holes therethrough.

The cross-sectional shape (in the y-z plane) at any point along the length of the heat spreader can include any shape that can convert the vertical momentum (z-axis direction in the attached Figures) of the hot gases into horizontal momentum (y-axis direction in the attached Figures). The conversion of vertical momentum into horizontal momentum at the heat spreader can direct the flow streams apart from one another and generally enlarge the distribution area for hot gases impinging the reflector, housing, or other headlamp assembly components. Specifically, the cross-sectional shape of the heat spreader can have an alphanumeric shape such as the shape of a "C", "M", "S", "T", "U", "V", "W", "Y", a shape similar to any of the foregoing shapes, an inversion of any of the foregoing shapes, a flat baffle, any shape capable of converting vertical momentum to horizontal momentum as the hot gases rise from the heat source, or a combination including at least one of the foregoing. Furthermore, the cross-sectional shape of the heat spreader can change along the length of the heat spreader (as measured along the x-axis direction). That is the cross-sectional shape of the heat spreader at one point along the length (x-axis direction) can be different than the cross-sectional shape of the heat spreader at another point along the length of the heat spreader.

A gas flow channel can be carved out of the skirt from the distal end. In other words, they can extend from the distal end of the skirt toward the front face the entire length, or only a portion of the length, of the skirt. Alternatively, the channels can extend from the perimeter edge of the front face only a portion of the length of the skirt, having skirt sections enclosing the channel on the distal end of the skirt. In this case, the channel becomes equivalent to a flow hole through the skirt as previously discussed. The gas flow channel can further include a centerline, which bisects the gas flow area of the channel along the length of the skirt. The shape of the flow channel can be symmetrical or asymmetrical about the flow channel centerline. The gas flow channels can further have any shape, and can be located anywhere along the skirt. When two flow channels are disposed in the skirt they can be located above the lamp and can be offset from the center line of the lamp shield and/or centerline of the lamp. When two flow channels are present the center lines of each channel can be less than or equal to 180° apart from one another as measured in the y-z plane (located towards opposing sides of the lamp). Specifically, the center line of each flow channel can be 20° to 180° apart from one another as measured in the y-z plane, for example, 30° to 120°, or, 60° to 90°, or, 90° apart from one another.

When only one gas flow channel or one gas flow hole is disposed in the skirt it can be shaped in such a way as to perform like multiple flow channels or holes. The single flow channel or hole can be shaped such that two or more primary flow regions (larger open area, larger flow) are created, connected by one or more secondary flow regions (smaller flow area, lower flow). In this sense the shape refers to the general shape of the channel or hole in the surface of the skirt. For example, a single flow channel or hole can have a generally "C", "M", "U", "V", "W", "Y", or similar shape such that a section of the shape establishes a large flow areas in comparison to another section of the shape. Similarly, a single flow hole or flow channel can have a "H", "T", "X", "Y", or similar shape such that the flow area at the point or points of intersection of the two or more lines defining the shape is small while the flow area at the terminal ends of each line is enlarged to allow more hot gas to flow through the terminal ends in comparison to gas flowing through the line intersections.

One of skill in the art will recognize that a full lamp shield is not needed in some lamp assemblies (e.g., in fog lights, high-beam lights, overhead lights, spot lights). In these cases a heat spreader can be utilized to spread the hot gases rising from the lamp and the front face and skirt can be largely, if not entirely, eliminated. This approach can be used in any application where a lamp shield is unnecessary, or when there is no need to shield the lamp from an onlooker, as when a visible light shield is integrated into the lamp bulb (e.g., an opaque portion disposed at lamp tip).

When present the size and number of the one or more flow holes and/or one or more flow channels can be chosen to balance the amount of visible light emitted to the reflector and the hot spot temperature(s) of the reflector, housing or other components of the headlamp assembly.

The cup portion can further include structural and or aesthetic elements formed into the front face and/or skirt. Structural elements such as ribs, channels, varied material thicknesses, protrusions, indentions, or a combination including at least one of the foregoing can act to retain the shape of the cup portion during operational loads (thermal loads from the lamp and mechanical loads from a moving vehicle). Aesthetic elements such as shape, size, length, color, hole pattern, protrusions, and the like can be formed to match the surrounding elements of the lamp assembly and provide a cohesive design sense to the viewer during both operational and non-operational modes (i.e. both when the lamp and vehicle are operating and not operating).

The lamp shield can further include an extended arm for securing the lamp shield within the headlamp assembly. The extended arm attaches to any portion of the cup portion of the lamp shield (e.g., distal end of skirt, front face, heat spreader, and the like) and extends to an attachment region within the headlamp assembly. The attachment region can include a mechanism for securing the lamp shield in the headlamp assembly so that the front face is oriented adjacent to tip the lamp, e.g., so as to block light emitted from the lamp that would be outside of a desired beam pattern. Examples of possible mechanisms for securing the lamp shield include snap engagements, securing elements (e.g., screws, rivets, bolts, and so forth), pressure fits, or a combination including at least one of the foregoing. The extended arm can include an attachment feature such as a hole, flange, tang, tab, pin, snap, hook, thread, rivet, weld point, or a combination including at least one of the foregoing for interacting with the securing mechanism of the attachment region for securely attaching the lamp shield within the headlamp assembly.

The extended arm can be configured to extend through the reflector at a point near the lamp base to minimize the number of penetrations through the reflector, or at a point remote from the lamp base, or can attach directly to the reflector.

The extended arm can further include structural reinforcing elements to prevent movement of the lamp shield when in use. In particular, the extended arm can include ribs, channels, bends, trusses, varied material thicknesses, or a combination including at least one of the foregoing. The structural reinforcing elements can be provided to reduce the deflection of the lamp shield when heated to operating temperatures (i.e. lamp, or multiple lamps within assembly, at full power) and subjected to loads associated with a moving vehicle.

The front face, skirt, gas flow holes, structural elements, extended arm, and/or flow channels can each be present, shaped, and/or located to enhance the aesthetic appeal to consumers, the structural integrity, the ease of manufacturing, the ease of assembly, the flow characteristics of the gases, or for any combination including at least one of the foregoing reasons. Flow characteristics as used herein at least refer to gas mixing, distributing gas flow, providing turbulence to the flow, creating more laminar flow, changing the residence time of hot gases in cavity, or a combination including at least one of the foregoing FIG. 1 depicts an exploded view of a headlamp assembly 10 including a lamp 80. The lamp 80 can include a housing 90. A reflector 14 can be disposed in the housing 90. A lamp shield 38 can be disposed in the housing 90 proximal the reflector 14. A lens 100 can be coupled to the housing. When assembled the lamp 80 can be centered and surrounded circumferentially by the reflector 14. The reflector can be surrounded circumferentially by the housing 90. The housing 90 can be configured to securely hold elements of the headlamp assembly 10 to attach the assembly 10 to a vehicle. The reflector can be configured to reflect and focus light emitted from the lamp, such as into a beam. The lens 100 can attach, such as directly, to the housing 90 to cover the reflector 14.

Figure 2:
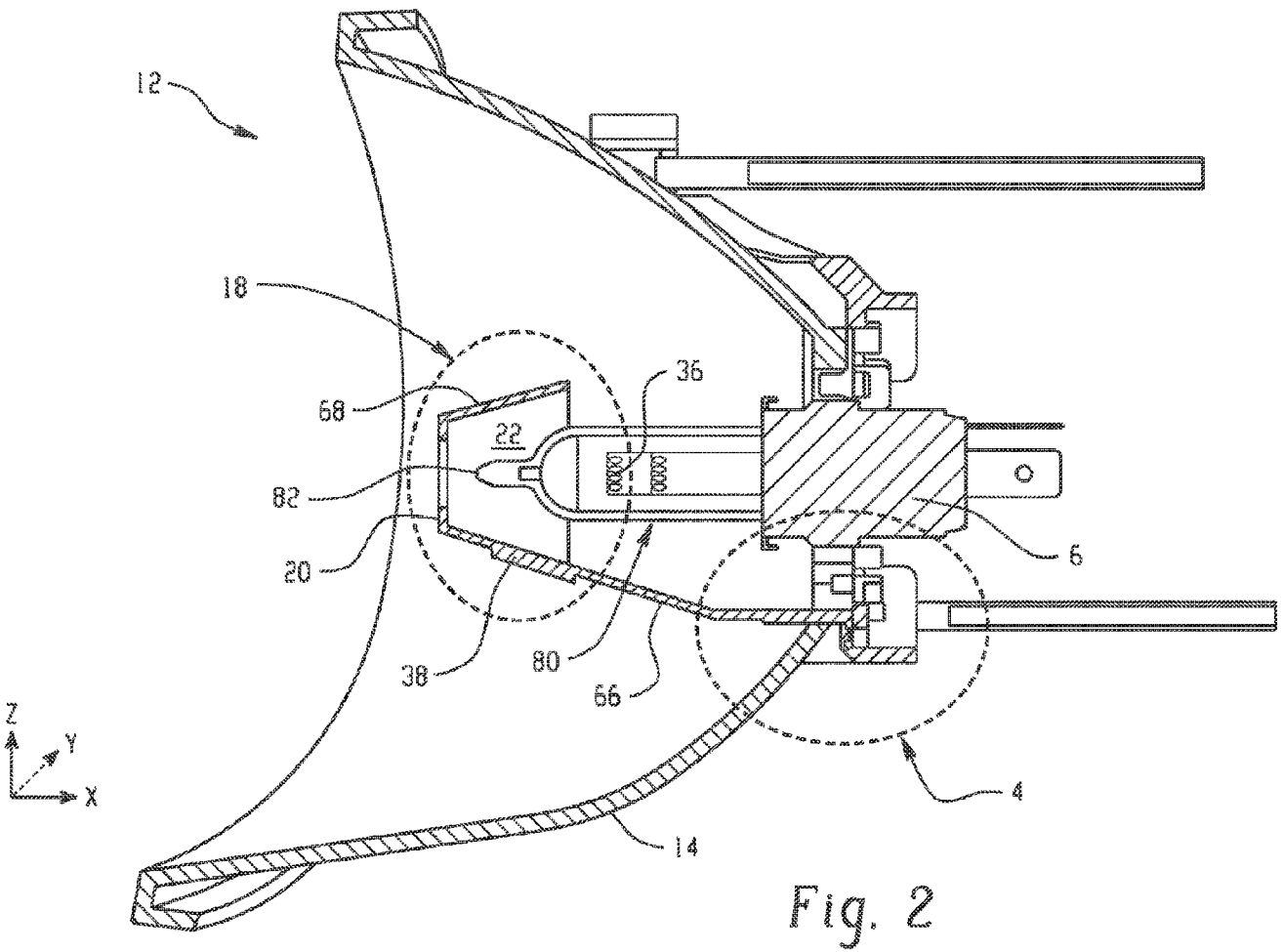
FIG. 2 depicts a headlamp assembly.

FIG. 2 depicts an assembly 12 including a lamp shield 38, a lamp 80, and a reflector 14. The lamp 80 extends in the x-direction and further includes a lamp base 6, a lamp tip 82, and at least one thermal energy source 36. The reflector 14 is generally concave and circumferentially surrounds both the lamp shield and the lamp such that when the lamp is energized (e.g., turned on) the reflector focuses the visible light emitted from the lamp into a beam. The reflector can be made of metals and/or plastics. The lamp shield 38 can be made of metals such as steel, steel alloys, aluminum, or aluminum alloys and further includes a cup portion 18 and an extended arm 66. The cup portion 18 can further include a front face 20, and a skirt 68 extending from the front face 20. Although shown in the attached figures as having a generally cylindrical shape, the cup portion 18 can have any shape that meets the manufacturing and performance requirements of the lamp shield (e.g., radiative shielding, light penetration or shielding, flow mixing, manufacturability, design temperature, stiffness, cost, aesthetic appearance, and the like). More specifically, the cup portion 18 can be formed in any shape that creates a cavity 22 into which at least a portion of lamp 80 can protrude. The extended arm 66 is configured to penetrate the reflector 14 and mount to an attachment region 4. The extended arm 66 can further include structural elements which provide structural integrity and can reduce or prevent deflection or movement (lateral, vertical, twisting, bending, flexing, and the like) of the lamp shield 38 relative to other components in the headlamp assembly 10 under combined thermal and mechanical loads associated with the energized lamp in a moving vehicle.

The polymer used in the reflector 14 can be selected from a wide variety of thermoplastic resins, blend of thermoplastic resins, thermosetting resins, or blends of thermoplastic resins with thermosetting resins, as well as combinations comprising at least one of the foregoing. The polymer may also be a blend of polymers, copolymers, terpolymers, or combinations comprising at least one of the foregoing. The organic polymer can also be an oligomer, a homopolymer, a copolymer, a block copolymer, an alternating block copolymer, a random polymer, a random copolymer, a random block copolymer, a graft copolymer, a star block copolymer, a dendrimer, or the like, or a combination comprising at least one of the foregoing. Examples of the organic polymer include polyacetals, polyolefins, polyacrylics, poly(arylene ether) polycarbonates, polystyrenes, polyesters (e.g., cycloaliphatic polyester, high molecular weight polymeric glycol terephthalates or isophthalates, and so forth), polyamides (e.g., semi-aromatic polyamide such as PA4.T, PA6.T, PA9.T, and so forth), polyamideimides, polyarylates, polyarylsulfones, polyethersulfones, polyphenylene sulfides, polyvinyl chlorides, polysulfones, polyimides, polyetherimides, polytetrafluoroethylenes, polyetherketones, polyether etherketones, polyether ketone ketones, polybenzoxazoles, polyphthalides, polyacetals, polyanhydrides, polyvinyl ethers, polyvinyl thioethers, polyvinyl alcohols, polyvinyl ketones, polyvinyl halides, polyvinyl nitriles, polyvinyl esters, polysulfonates, polysulfides, polythioesters, polysulfones, polysulfonamides, polyureas, polyphosphazenes, polysilazanes, styrene acrylonitrile, acrylonitrile-butadiene-styrene (ABS), polyethylene terephthalate, polybutylene terephthalate, polyurethane, ethylene propylene diene rubber (EPR), polytetrafluoroethylene, fluorinated ethylene propylene, perfluoroalkoxyethylene, polychlorotrifluoroethylene, polyvinylidene fluoride, or the like, or a combination comprising at least one of the foregoing organic polymers. Examples of polyolefins include polyethylene (PE), including high-density polyethylene (HDPE), linear low-density polyethylene (LLDPE), low-density polyethylene (LDPE), mid-density polyethylene (MDPE), glycidyl methacrylate modified polyethylene, maleic anhydride functionalized polyethylene, maleic anhydride functionalized elastomeric ethylene copolymers (like EXXELOR VA1801 and VA1803 from ExxonMobil), ethylene-butene copolymers, ethylene-octene copolymers, ethylene-acrylate copolymers, such as ethylene-methyl acrylate, ethylene-ethyl acrylate, and ethylene butyl acrylate copolymers, glycidyl methacrylate functionalized ethylene-acrylate terpolymers, anhydride functionalized ethylene-acrylate polymers, anhydride functionalized ethylene-octene and anhydride functionalized ethylene-butene copolymers, polypropylene (PP), maleic anhydride functionalized polypropylene, glycidyl methacrylate modified polypropylene, and a combination comprising at least one of the foregoing polymers.

Examples of blends of thermoplastic resins include acrylonitrile-butadiene-styrene/nylon, polycarbonate/acrylonitrile-butadiene-styrene, acrylonitrile butadiene styrene/polyvinyl chloride, polyphenylene ether/polystyrene, polyphenylene ether/nylon, polysulfone/acrylonitrile-butadiene-styrene, polycarbonate/thermoplastic urethane, polycarbonate/polyethylene terephthalate, polycarbonate/polybutylene terephthalate, thermoplastic elastomer alloys, nylon/elastomers, polyester/elastomers, polyethylene terephthalate/polybutylene terephthalate, acetal/elastomer, styrene-maleic-anhydride/acrylonitrile-butadiene-styrene, polyether etherketone/polyethersulfone, polyether etherketone/polyetherimide polyethylene/nylon, polyethylene/polyacetal, or the like.

Examples of thermosetting resins include polyurethane, natural rubber, synthetic rubber, epoxy, phenolic, polyesters, polyamides, silicones, or the like, or a combination comprising at least one of the foregoing thermosetting resins. Blends of thermoset resins as well as blends of thermoplastic resins with thermosets can be utilized.

For example, the polymer that can be used in the reflector can be a polyetherimide (PEI) or polyarylene ether. The term poly(arylene ether) polymer includes polyphenylene ether (PPE) and poly(arylene ether) copolymers; graft copolymers; poly(arylene ether) ionomers; and block copolymers of alkenyl aromatic compounds with poly(arylene ether)s, vinyl aromatic compounds, and poly(arylene ether), and the like; and combinations including at least one of the foregoing.

Figure 3:
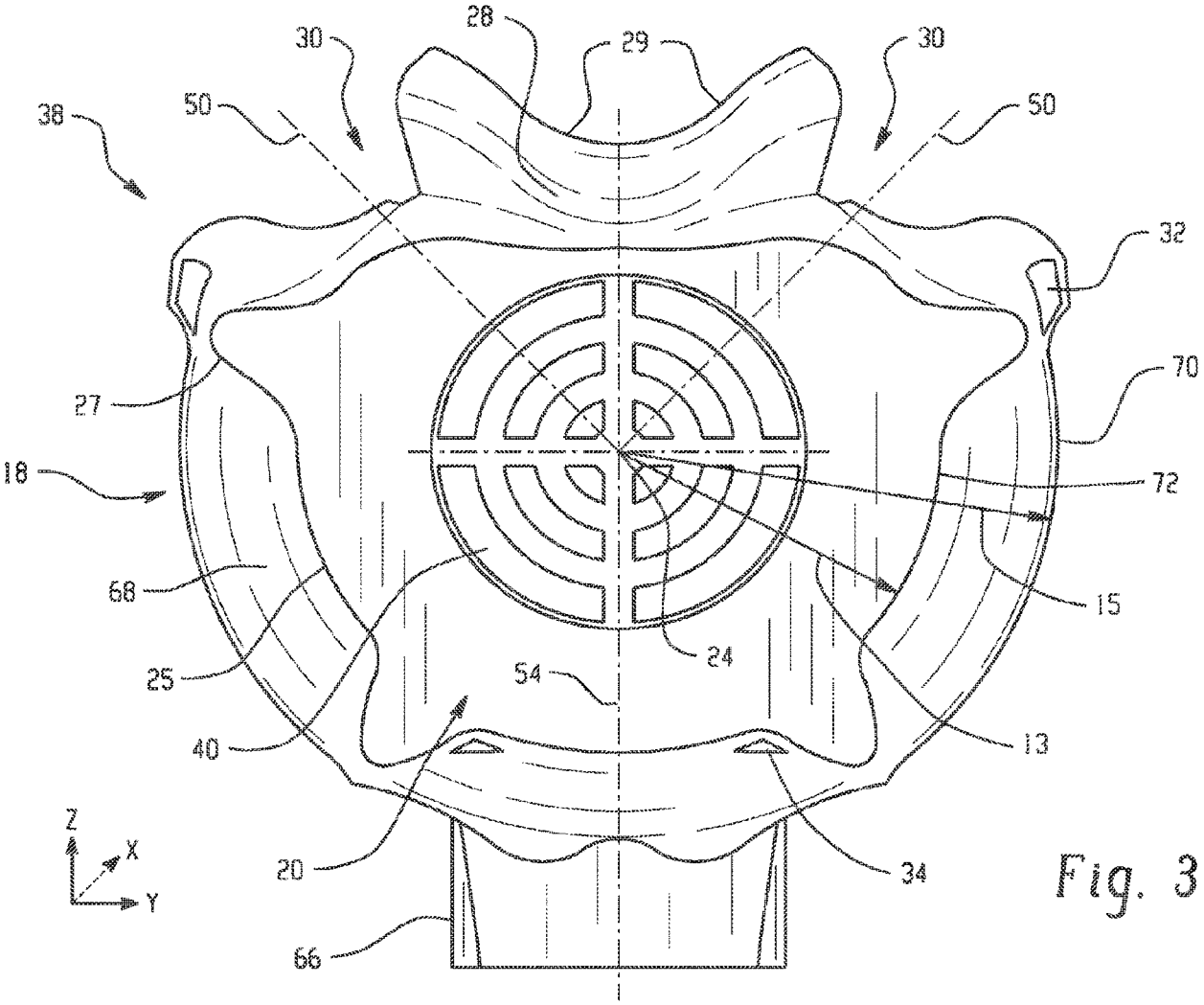
FIG. 3 depicts a lamp shield with a heat spreader.
Figure 4:
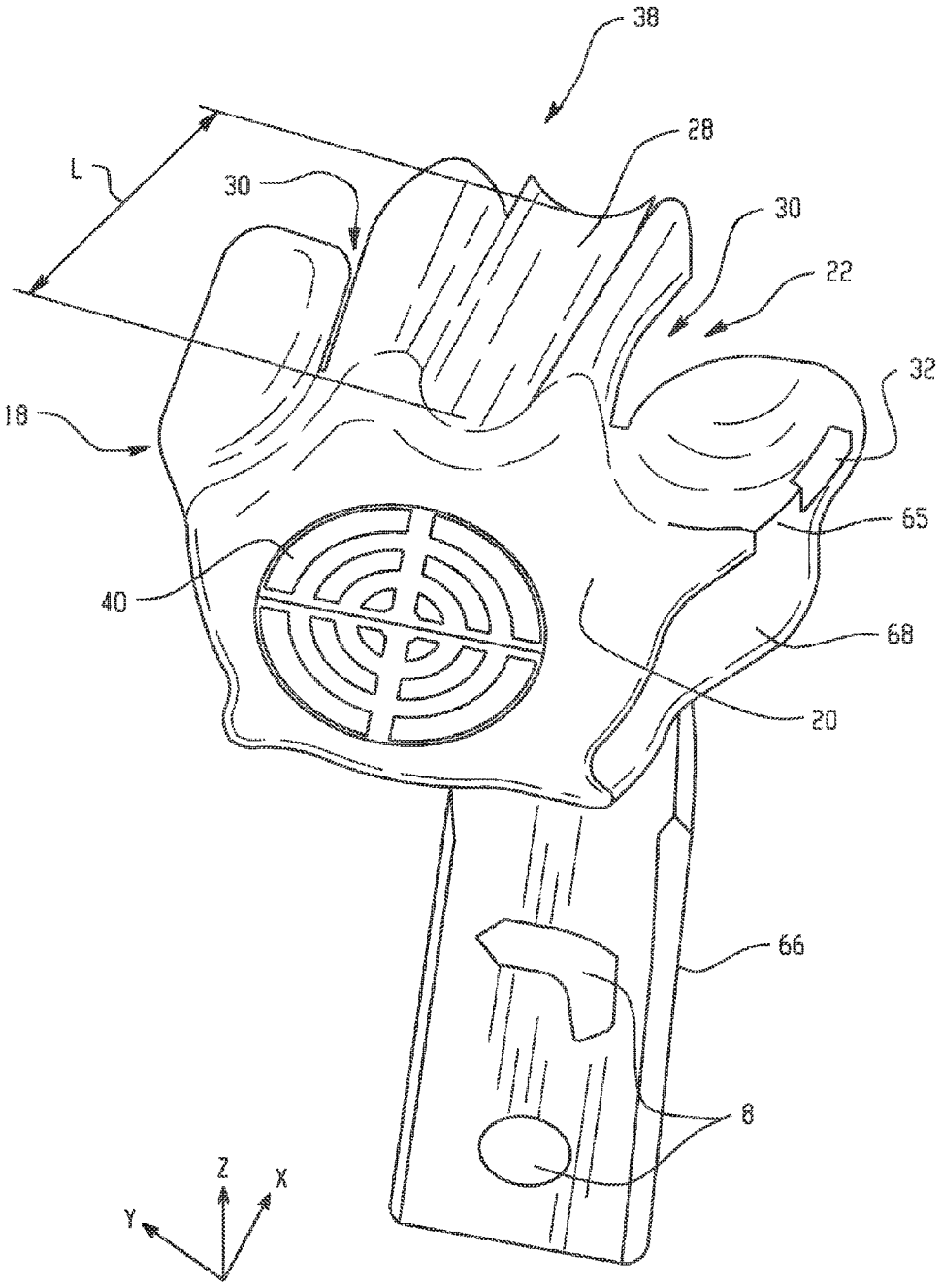
FIG. 4 depicts a front view of the lamp shield of FIG. 3.
Figure 5:
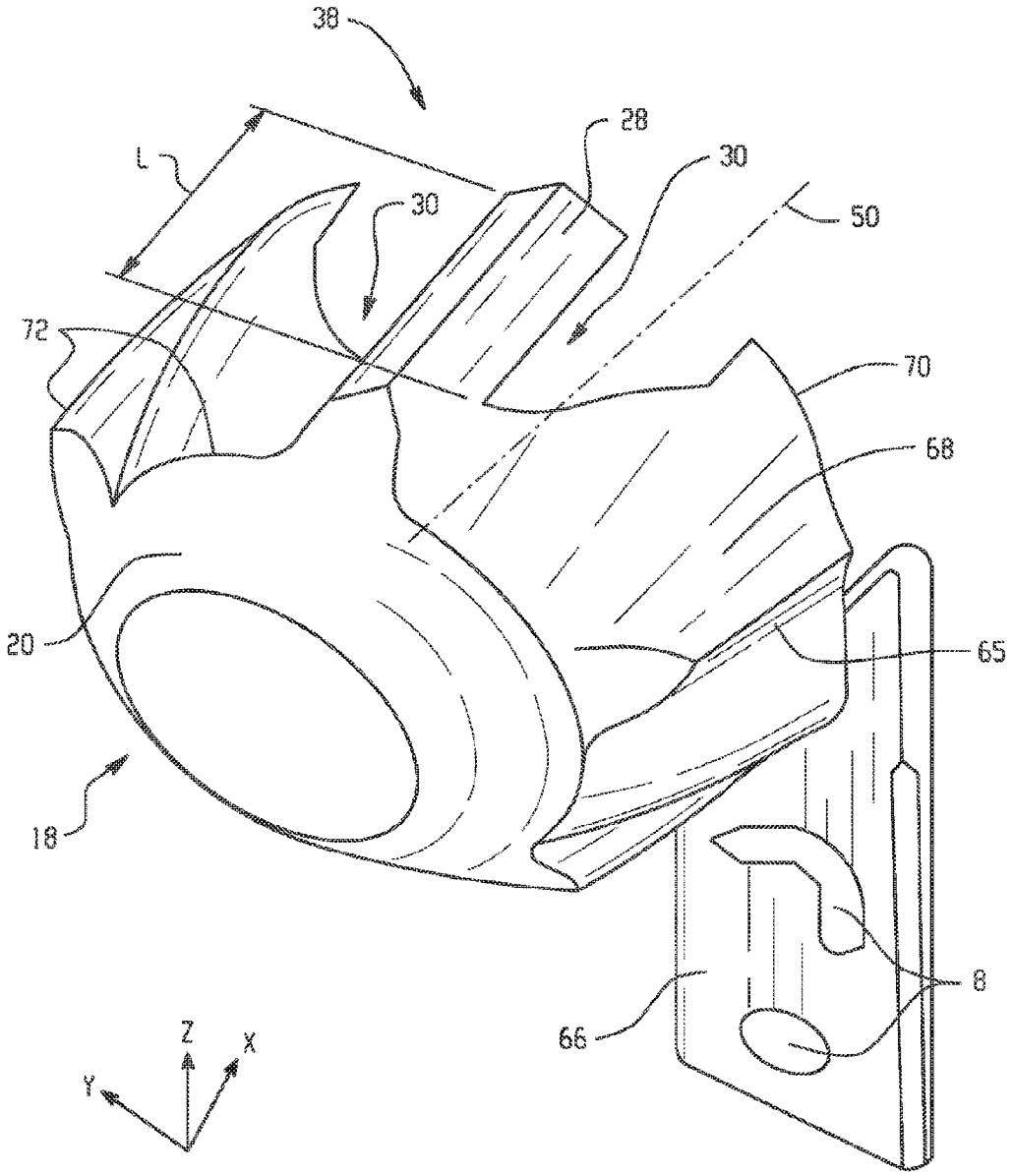
FIG. 5 depicts a lamp shield with an inverted "V" shaped heat spreader.

FIGS. 3-5 depict a lamp shield 38 including a cup portion 18 and an extended arm 66. The cup portion 18 further includes a front face 20 having a perimeter edge 25 and a skirt 68 attached to the perimeter edge and extending in the x-axis direction away from the front face to form a cavity 22. The skirt 68 is generally cylindrical, but has a slight conical shape, the walls of the cylinder converging slightly as they attach to the front face. The front face 20 is generally circular. In FIGS. 3-4 the front face includes multiple gas flow holes 40 therethrough in a circular pattern, while the front face in FIG. 5 is closed, without openings therethrough. The gas flow holes 40 through the front face 20 (FIGS. 3-4) are shown to be equally spaced radially and circumferentially about the centroid 24 of the front face 20 forming a circular pattern, although any pattern is contemplated. The skirt 68 has a proximal end 72 which connects the skirt to the perimeter edge 25 of the front face 20, and extends to a distal end 70, the end of the skirt opposite the font face. The front face 20 further includes protrusions 27. These protrusions 27 are circumferentially distributed around the perimeter edge 25 of the front face 20 and extend radially form the front face to form ribs 65 which extend along at least a portion of the length of the skirt 68 as measured in the x-axis direction. In these figures the skirt radius 13 at the proximal end of the skirt 72 is smaller than the skirt radius 15 at the distal end skirt so the ribs protrude farther from the surface of the skirt at the proximal end 72 than at the distal end 70 of the skirt.

The lamp shield 38 further includes one heat spreader 28 and two flow channels 30 to allow gases to enter and exit the cavity 22. The gas flow channels 30 can be a result of the skirt shape or can be the result of material removed, or cut out of, the skirt. Each flow channel 30 extends axially along a portion of the length of the skirt as measured in the x-axis direction, and extends circumferentially around a portion of the skirt. The flow channels 30 further includes a centerline 50 which bisects the flow channel 30 along the length of the skirt as measured in the x-axis direction, i.e. splits the open area of the skirt which forms the channel into two, equal flow area, sections. The centerlines of the two flow channels are offset approximately 45° to either side of the lamp shield centerline 54, such that centerlines 50 are approximately 90° apart from one another. In these figures the flow channels 30 are asymmetrical about the flow channel centerline 50, although symmetrical flow channels are contemplated.

The skirt 68 in FIGS. 3-4 further includes upper skirt gas flow holes 32 and lower skirt flow holes 34 (these holes are also called openings). These gas flow holes (32, 34) through the skirt allow for gases to move into and out of the cavity 22. The movement can be due to free convection resulting from temperature differences between the gases in different open volumes of headlamp assembly.

The gas flow channels 30 and/or gas flow holes (32, 34, and 40) provide flow paths for gases to enter and exit the cavity 22. These flow paths split the hot gases rising vertically into multiple flow streams and spread the stream laterally, in the y-axis direction, away from one another and away from the lamp shield centerline 54. The openings further allow some of the hot gas to rise while urging only a portion of the flow toward the lamp base 6. By reducing the rearward component of gas velocity vector and splitting the flow in the y-axis direction, the hotter gases proximal to the lamp can spread (in the y-axis direction) and flow away from the lamp base 6 and away from the lamp shield centerline 54. This distributes the total enthalpy of the hot gases over a larger area of the headlamp assembly, which can further reduce the thermal load imparted on the headlamp assembly components and can reduce hot spot temperatures (maxima of the temperature profile) within the assembly. Consequently, the average and maximal surface temperatures of the reflector 14 and the housing 90 in the area proximal to the lamp base and directly above the lamp are consequently reduced. Providing multiple flow paths for the hot gas can result in multiple hot spots within the head lamp assembly (at the reflector, the housing, or at another component of the assembly), but each hot spot can have a lower temperature than if the streams were not split. Essentially, splitting the gas streams will more evenly distribute the heat released from the lamp and result in a more uniform temperature distribution throughout the headlamp assembly. The total amount of energy that is released into the headlamp assembly by the lamp is unchanged, but with gas flow channels 30 and/or gas flow holes (32, 34, and 40) the energy is distributed more evenly, resulting in narrower temperature distribution throughout the surfaces of the headlamp assembly (i.e. smaller standard deviation in the surface temperature distribution throughout the headlamp assembly).

In addition to reducing the rearward momentum of the hot gases flowing from the lamp and more uniformly distributing the hot gases flowing upward from the lamp, the flow paths created by the gas flow channel and/or gas flow holes allow lower temperature gases outside the cavity 22 to enter the cavity and mix with the gases proximal to the lamp 80. Mixing of the cooler gases from outside the cavity 22 with hotter gases inside the cavity reduces the temperature of the hotter gases proximal to the lamp and further reduces hot spot temperatures that can develop on the reflector.

The heat spreader 28 has a length L as measured in the x-axis direction and a cross-sectional shape along the length. The cross-sectional shape of the heat spreader is the shape of the heat spreader as projected onto the y-z plane from any point along the length L of the heat spreader. In other words, the cross-sectional shape of the heat spreader is the shape in a plane parallel to the y-z plane at any point along the length L of the heat spreader.

The heat spreader 28 shown in FIGS. 3-4 has a cross-sectional shape of two elongated "S" shapes 29 (also called lazy "S" shapes) mirroring each other on opposing sides of the heat spreader and connected at the bottom of the "S". The lazy "S" shapes 29 on either side of the heat spreader 28, adjacent the flow channels 30, direct gas flow rising vertically from the cavity 22, and/or from the lamp 80, laterally away from the centerline 54. In other words, these shapes converts vertical gas momentum (in the z-axis direction) into horizontal momentum (in the y-axis direction) and act to spread the gas flow laterally away from the centerline 54.

The heat spreader 28 shown in FIG. 5 has an inverted "V" shape. This shape also acts to convert vertical gas momentum (z-axis direction) into horizontal momentum (y-axis direction) and acts like a baffle, splitting the gas flow laterally in the y-axis direction into two streams. In this example the heat spreader 28 is also coincident with a rib 65 protruding radially from the front face 20 and extending along the length of the skirt 68.

EXAMPLES

The Applicants found that providing two flow channels, spaced approximately 45° to either side of the lamp shield center line 54, and consequently about 90° apart from one another, forming a heat spreader therebetween and where either side of the heat spreader (sides adjacent to a flow channel) had a lazy "S" cross-sectional shape 29 (the cross-sectional shape of one side of the heat spreader the mirror image of the other) resulted in a decrease (relative to a lamp shield without flow channels and heat spreader) of approximately 26° C. (47° F.) in reflector hot spot temperature as measured on the surface of the reflector. The Applicants found that front face gas flow holes had less of an effect in the hot spot temperatures measured on the surface of the reflector. When gas flow holes where provided through the front face the hot spot temperatures decreased by about 2° C. (4° F.).

Set forth below are examples of the lamp shields described herein, and headlamp assemblies comprising the same.

Embodiment 1

A lamp shield comprising: a front face; a skirt extending from the front face, wherein the skirt comprises a heat spreader; and an extended arm connected to the front face or the skirt.

Embodiment 2

The lamp shield of Embodiment 1, wherein the skirt comprises a gas flow channel extended from a distal end of the skirt.

Embodiment 3

The lamp shield of Embodiment 2, wherein the skirt comprises two gas flow channels.

Embodiment 4

The lamp shield of Embodiment 3, wherein a centerline of each of the two gas flow channels are 20° to 180° apart from one another as measured in a plane defined by a y-axis and a z-axis.

Embodiment 5

The lamp shield of Embodiment 3, wherein a centerline of each of the two gas flow channels are 60° to 90° apart from one another as measured in a plane defined by a y-axis and a z-axis.

Embodiment 6

The lamp shield of any of Embodiments 1-5, wherein the skirt further comprises a gas flow hole therethrough.

Embodiment 7

The lamp shield of any of Embodiments 1-6, wherein the front face further comprises a gas flow hole therethrough.

Embodiment 8

The lamp shield of any of Embodiments 1-7, wherein the heat spreader further comprises a gas flow hole therethrough.

Embodiment 9

The lamp shield of any of Embodiments 1-8, wherein the heat spreader further comprises a length as measured along an x-axis, and a cross-sectional shape at any point along the length, wherein the cross-sectional shape is capable of converting a vertical momentum, along a z-axis direction, of a gas impinging the heat spreader into a horizontal momentum, along a y-axis direction.

Embodiment 10

The lamp shield of Embodiment 9, wherein the cross-sectional shape at any point along the length of the heat spreader as measured along the x-axis has a "C" shape, a "M" shape, a "S" shape, a "T" shape, a "U" shape, a "V" shape, a "W" shape, a "X" shape, a "Y" shape, an inversion of any of the foregoing shapes, a flat baffle, or a similar shape, or a combination comprising at least one of the foregoing.

Embodiment 11

The lamp shield of any of Embodiments 1-10, wherein the heat spreader extends from a distal end of the skirt.

Embodiment 12

The lamp shield of any of Embodiments 1-11, wherein the lamp shield comprises metal.

Embodiment 13

A headlamp assembly comprising: a reflector; and a lamp shield of any of Embodiments 1-12.

Embodiment 14

The headlamp assembly of Embodiment 13, wherein the reflector comprises a plastic resin.

Embodiment 15

The headlamp assembly of Embodiment 14, wherein the plastic resin comprises polyetherimide.

Embodiment 16

A lamp shield comprising: a front face; a skirt extending from the front face, wherein the skirt comprises two gas flow channels extended from the distal end of the skirt, wherein a centerline of each of the two gas flow channels are 20° to 180° apart from one another as measured in a plane defined by a y-axis and a z-axis; wherein the skirt comprises a heat spreader disposed between the two gas flow channels, and wherein the skirt comprises a gas flow hole therethrough, wherein the heat spreader comprises a length as measured along an x-axis, and a cross-sectional shape at any point along the length, wherein the cross-sectional shape is capable of converting a vertical momentum, along a z-axis direction, of a gas impinging the heat spreader into a horizontal momentum, along a y-axis direction; and an extended arm connected to the front face or the skirt.

Embodiment 17

The lamp shield of Embodiment 16, wherein the skirt further comprises a gas flow hole therethrough.

In general, the invention may alternately comprise, consist of, or consist essentially of, any appropriate components herein disclosed. The invention may additionally, or alternatively, be formulated so as to be devoid, or substantially free, of any components, materials, ingredients, adjuvants or species used in the prior art compositions or that are otherwise not necessary to the achievement of the function and/or objectives of the present invention.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). "Combination" is inclusive of blends, mixtures, alloys, reaction products, and the like. Furthermore, the terms "first," "second," and the like, herein do not denote any order, quantity, or importance, but rather are used to denote one element from another. The terms "a" and "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

I claim:

1. A lamp shield comprising:

a front face;

a skirt extending from the front face, wherein the skirt comprises a heat spreader between two gas flow channels; and an extended arm connected to the front face or the skirt;

wherein the heat spreader is located in an upper section of the lamp shield, vertically above a centroid of the front face of the lamp shield; and wherein a cross-sectional shape at any point along a length of the heat spreader as measured along an x-axis has a "C" shape, a "M" shape, a "S" shape, a "T" shape, a "U" shape, a "V" shape, a "W" shape, a "X" shape, a "Y" shape, an inversion of any of the foregoing shapes, or a similar shape, or a combination comprising at least one of the foregoing;

such that a gas stream impinging the inside of the heat spreader is split into multiple streams and urged laterally away from a vertical centerline of the lamp without urging the entire gas flow rearward toward a lamp base.

2. The lamp shield of claim 1, wherein the gas flow channels extend from a distal end of the skirt.

3. The lamp shield of claim 1, wherein a centerline of each of the two gas flow channels are 20° to 180° apart from one another as measured in a plane defined by a y-axis and a z-axis.

4. The lamp shield of claim 1, wherein a centerline of each of the two gas flow channels are 60° to 90° apart from one another as measured in a plane defined by a y-axis and a z-axis.

5. The lamp shield of claim 1, wherein the skirt further comprises a gas flow hole therethrough.

6. The lamp shield of claim 1, wherein the front face further comprises a gas flow hole therethrough.

7. The lamp shield of claim 1, wherein the heat spreader further comprises a gas flow hole therethrough.

8. The lamp shield of claim 1, wherein the cross-sectional shape at any point along the length of the heat spreader as measured along the x-axis is capable of converting a vertical momentum, along a z-axis direction, of a gas impinging the heat spreader into a horizontal momentum, along a y-axis direction.

9. The lamp shield of claim 8, wherein the cross-sectional shape at any point along the length of the heat spreader as measured along the x-axis has an "S" shape.

10. The lamp shield of claim 1, wherein the heat spreader extends from a distal end of the skirt.

11. The lamp shield of claim 1, wherein the lamp shield comprises metal.

12. A headlamp assembly comprising:

a reflector; and the lamp shield of claim 1.

13. The headlamp assembly of claim 12, wherein the reflector comprises a plastic resin.

14. The headlamp assembly of claim 13, wherein the plastic resin comprises polyetherimide.

* * * * *